US009671752B2

(12) United States Patent
Taniyama et al.

(10) Patent No.: US 9,671,752 B2
(45) Date of Patent: Jun. 6, 2017

(54) OPTICAL WRITING DEVICE EQUIPPED WITH LIGHT EMITTING ELEMENTS

(71) Applicant: Konica Minolta, Inc., Chiyoda-ku, Tokyo (JP)

(72) Inventors: Akira Taniyama, Toyokawa (JP); So Yano, Ibaraki (JP); Takahiro Matsuo, Toyokawa (JP); Yasushi Nagasaka, Okazaki (JP); Takaki Uemura, Seto (JP); Masayuki Iijima, Okazaki (JP)

(73) Assignee: KONICA MINOLTA. INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/153,235

(22) Filed: May 12, 2016

(65) Prior Publication Data

US 2016/0334756 A1 Nov. 17, 2016

(30) Foreign Application Priority Data

May 13, 2015 (JP) ..... 2015-097892

(51) Int. Cl.
*G03G 21/20* (2006.01)
*G03G 15/043* (2006.01)
*G03G 15/04* (2006.01)

(52) U.S. Cl.
CPC ..... *G03G 21/20* (2013.01); *G03G 15/043* (2013.01); *G03G 15/04063* (2013.01)

(58) Field of Classification Search
CPC . G03G 21/20; G03G 15/043; G03G 15/04063
See application file for complete search history.

(56) References Cited

U.S. PATENT DOCUMENTS 8,369,727 B2 * 2/2013 Oguchi ..... G03G 15/326 399/220
9,389,561 B2 * 7/2016 Kobayashi ..... G03G 15/0131
2005/0174419 A1 * 8/2005 Kitazawa ..... B41J 2/447 347/118

FOREIGN PATENT DOCUMENTS

JP S62-280057 A 12/1987
JP S62-299360 A 12/1987
(Continued)

OTHER PUBLICATIONS

Office Action (Notice of Reasons for Refusal) dated May 2, 2017 issued by the Japanese Patent office corresponding JP Application No. 2015-097892, and an English language translation (7 pages).

*Primary Examiner* — Gregory H Curran
(74) *Attorney, Agent, or Firm* — Buchanan Ingersoll & Rooney PC

(57) ABSTRACT

An optical writing device adopting a low cost and simple structure can obtain temperatures of light emitting elements. The device comprises a plurality of light emitting elements arranged linearly in a main scanning direction. The amount of light emitting of the light emitting elements changes by self-generated heat. The light emitting elements are divided into a plurality of groups. Each of the groups includes a prescribed number of light emitting elements. The device comprises a control unit for calculating the amount of heat generation of the light emitting elements for each of groups from clock time t0 to clock time t0+Δt. The control unit calculates the temperature for each of the groups at the clock time t0+Δt, based on the amount of heat generation from the clock time t0 to the clock time t0+Δt and the temperature at the clock time t0.

9 Claims, 14 Drawing Sheets

(56) References Cited

FOREIGN PATENT DOCUMENTS

| | | | |
|---|---|---|---|
| JP | H09-300696 | A | 11/1997 |
| JP | 2003-237124 | A | 8/2003 |
| JP | 2008-177107 | A | 7/2008 |
| JP | 2010-120199 | A | 6/2010 |
| JP | 4513528 | B2 | 7/2010 |
| JP | 2014-013335 | A | 1/2014 |
| JP | 2006-119445 | A | 5/2016 |

* cited by examiner

OPTICAL WRITING DEVICE EQUIPPED WITH LIGHT EMITTING ELEMENTS

This application is based on Japanese Patent Application No. 2015-097892 filed with the Japan Patent Office on May 13, 2015, the entire content of which is hereby incorporated by reference.

BACKGROUND OF THE INVENTION

Field of the Invention

This invention relates to an optical writing device being equipped with a plurality of light emitting elements, and to an image forming apparatus being equipped with the optical writing device. The amounts of emitting light of the plurality of light emitting elements change by the self-generated heat. The plurality of light emitting elements are arranged linearly in a main scanning direction.

Description of the Related Art

Organic electroluminescence elements (hereinafter referred to as organic EL elements) are recently used as light emitting elements in displays, lighting equipment, or the like. As seen from FIG. 10, an organic EL element 100 have a structure in which positive electrode 102 composed of a transparent electrode such as indium oxide (ITO) on transparent board 101, at least one organic layer 103 on positive electrode 102, and negative electrode 104 composed of an electrode of aluminum or the like on organic layer 103 are stacked. When drive electrical current flows or drive electrical voltage is applied between positive electrode 102 and negative electrode 104 by electric power supply 105, organic layer 103 emits light. The light is taken out, via transparent electrode 102 and transparent board 101.

As shown by FIG. 11, the amount of light emitted from an organic EL element changes, depending on the element temperature. Organic EL elements generate a great deal of heat by themselves, relative to other light emitting elements (LED (Light Emitting Diode), LD (Laser Diode), or the like). For example, when an organic EL element emits light continuously for about 5 minutes, the temperature of the element rises by 30 degrees Celsius as shown in FIG. 12.

As shown in FIG. 13, when organic EL element emits light by a same drive electrical current, the light emitting amount of the element decreases, as integral light emitting time increases (a light amount deterioration characteristics). The degree of the light amount deterioration is larger, when the element temperature is higher during the drive. Also, the degree of the light amount deterioration is larger, when the electrical current density is larger during the drive.

The above explained organic EL elements may be recently used in an optical writing device of an image forming apparatus. The optical writing device has a plurality of organic EL elements being linearly arranged, parallel to the main scanning direction, and is used when the photo conductor is exposed. However, the photo conductor can not be irradiated with proper amount light, when the amount of light emitting of each element changes by self-generated heat. In consequence, the quality of images being formed by the image forming apparatus may deteriorate.

In case that the amounts of light emitting differ among a plurality of organic EL elements, the ununiformity among temperatures of the elements occurs by self-generated heat. Since the amount of light emitting of each element changes depending on the temperature, the photo conductor can not be irradiated with proper amounts light emitted from elements. In consequence, the quality of images being formed by the image forming apparatus may deteriorate.

According to the above mentioned background, conventional optical writing devices detect temperatures of organic EL elements, and execute temperature correction based on the detection result (see Documents 1 and 2 below).

DOCUMENTS

[Document 1] Japan Patent Publication No. 2006-119445

[Document 2] Japan Patent No. 4,513,528

According to the above Document 1, temperatures of organic EL elements being used for the exposure are detected by drive electrical current or drive electrical voltage of organic EL elements for detection not being used for the exposure. Temperature correction is executed based on the detection result. However, because of space limitations, the number of organic EL elements for detection which can be installed on an optical writing device is limited. Hence, the ununiformity among temperatures of a plurality of organic EL elements can not be recognized precisely.

According to the above Document 2, drive electrical current or drive electrical voltage of each organic EL element is measured, and the element temperature is estimated based on the drive electrical current or the drive electrical voltage. Temperature correction for light emitting elements is executed, based on the estimation result. However, costs of an optical writing device increase, since circuits for measuring the drive electrical current or the drive electrical voltage should be installed.

Considering the above problems, the object of this invention is to provide optical writing devices and image forming apparatuses which can obtain temperatures of light emitting elements, for temperature correction of the light emitting elements, by adopting a low cost and simple structure.

SUMMARY OF THE INVENTION

According to an aspect of this invention, an optical writing device comprising: a plurality of light emitting elements being arranged linearly in a main scanning direction, wherein an amount of light emitting of the plurality of light emitting elements changes by self-generated heat, and the plurality of light emitting elements are divided into a plurality of groups, each of the groups includes a prescribed number of light emitting elements which are arranged in the main scanning direction, the optical writing device further comprising: a control unit for calculating an amount of heat generation of the plurality of light emitting elements for each of the groups from clock time t0 to clock time t0+Δt, wherein the control unit further calculates a temperature for each of the groups at the clock time t0+Δt, based on the amount of heat generation from the clock time t0 to the clock time t0+Δt and a temperature at the clock time t0.

According to another aspect of this invention, an image forming apparatus is equipped with the above mentioned optical writing device.

DESCRIPTION OF THE PREFERRED EMBODIMENTS

An optical writing device and an image forming apparatus will be explained with the drawings, in the following paragraphs.

Chapter 1: Definition

Figure 1:
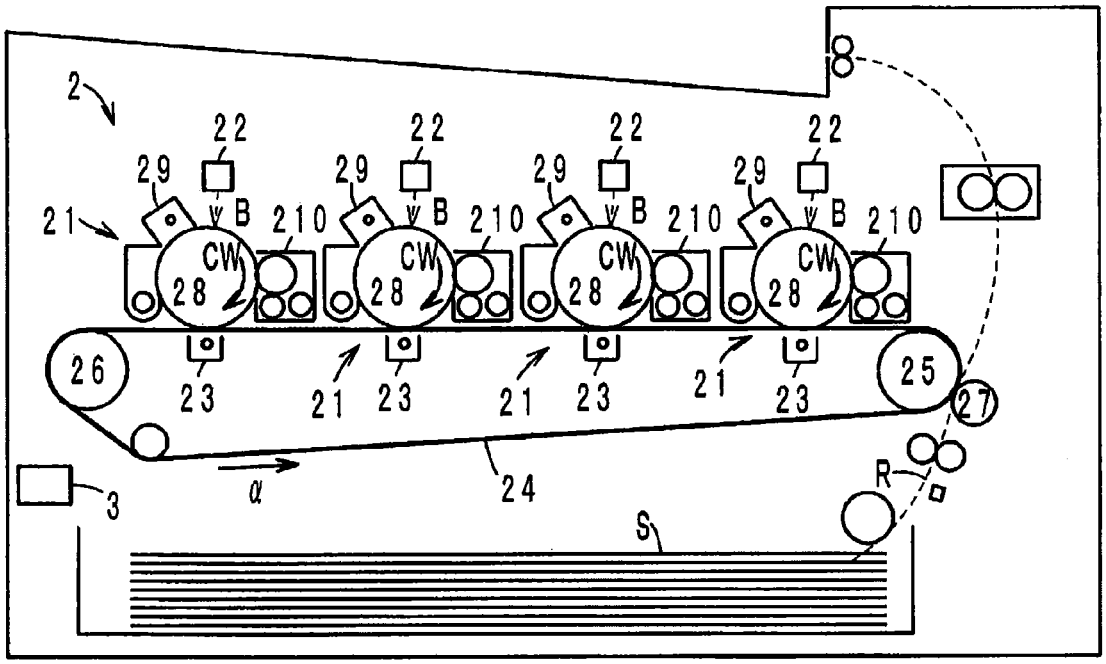
FIG. 1 schematically shows a vertical cross-sectional view of an image forming apparatus.
Figure 1:
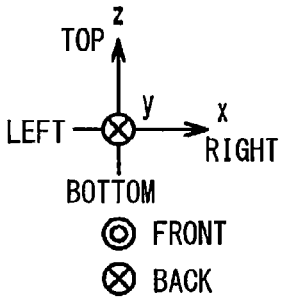

In FIG. 1 etc., X axis indicates a direction showing right and left of an image forming apparatus. Y axis indicates a direction showing the front and back of the image forming apparatus. Z axis indicates the perpendicular direction of the image forming apparatus. The Y axis shows the main scanning direction of optical beam B.

Chapter 2: Printing Behavior of the Image Forming Apparatus

In FIG. 1, image forming apparatus 1 is an MFP (Multi-function Peripheral), for example. Image forming apparatus 1 forms toner images for a plurality of colors, by using photo conductor drums 28 for the plurality of colors. Image forming apparatus 1 synthesizes the toner images for the plurality of colors on secondary transfer belt 24. After that, image forming apparatus 1 transfers the synthesized toner image to recording media S. This printing process will be fully explained in the followings.

In image forming apparatus 1, a supply unit sends forth recording media S one by one, on conveying path R, toward a pair of downstream timing rollers. The recording medium S temporarily stops at a position where the recording medium S contacts with the pair of downstream timing rollers stopping. Then, the pair of timing rollers starts rotating. The recording medium S is sent forth to the secondary transfer area, which will be explained in the followings.

Image forming apparatus 1 is equipped with process unit 2. Process unit 2 includes sets of image forming unit 21, optical writing device 22 and transfer unit 23, for colors of Y (yellow), C (cyan), M (magenta), and K (black). Process unit 2 further includes secondary transfer belt 24, drive roller 25, driven roller 26 and secondary transfer roller 27.

Each of the image forming units 21 is schematically equipped with photo conductor drums 28, electrostatic charging unit 29 which is installed along with the periphery of the photo conductor drums 28, and developing unit 210. Four photo conductor drums 28 are parallely placed in a direction showing right and left. Photo conductor drums 28 for the colors extend in the Y-axis direction, and rotate on the axes which are parallel to the Y axis. A direction opposite to the rotational direction CW of photo conductor drum 28 is a sub scanning direction of optical beam B. Electrostatic charging unit 29 extends in the Y-axis direction, and uniformly electrostatic-charges the periphery of photo conductor drum 28 which corresponds to the electrostatic charging unit 29.

Figure 2:
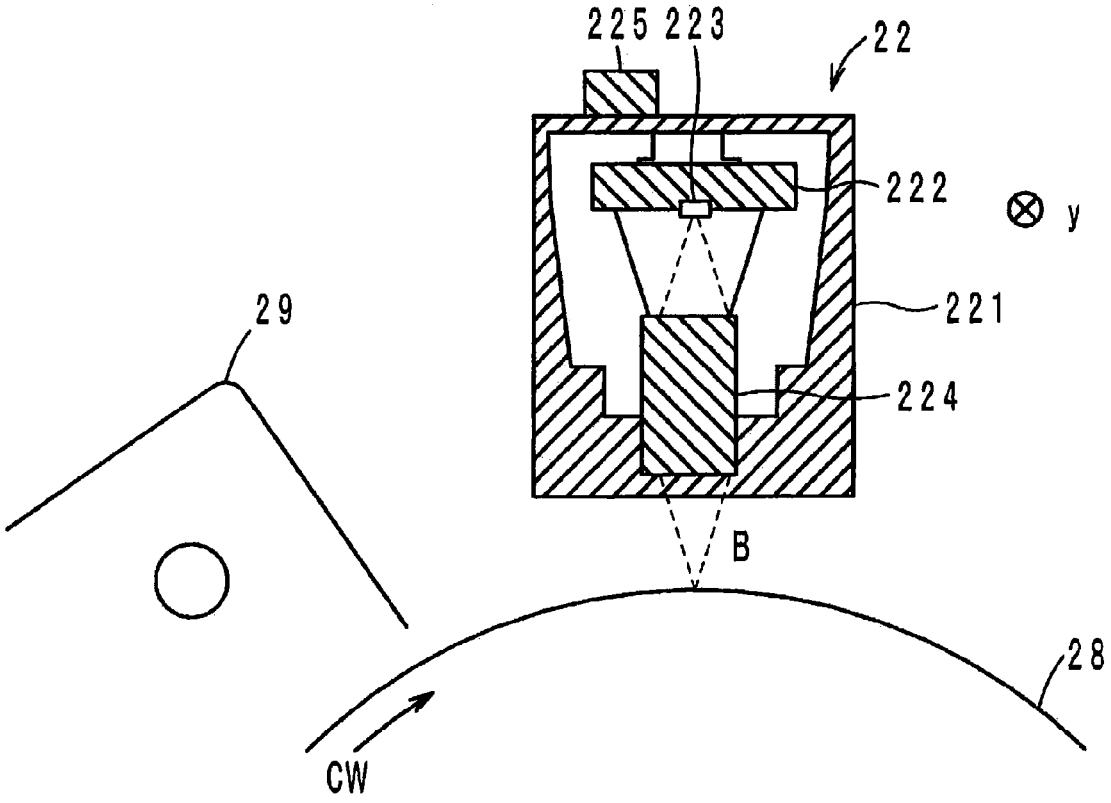
FIG. 2 shows a vertical cross-sectional view of an optical writing device in FIG. 1.
Figure 3:
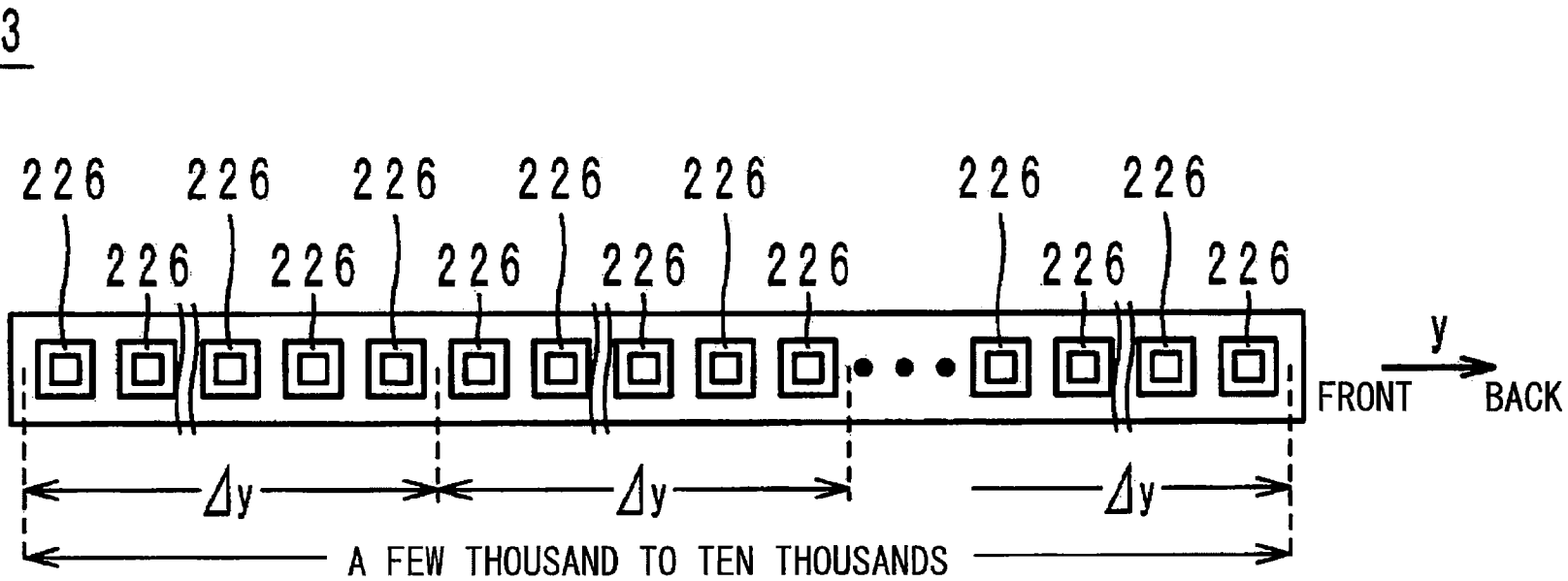
FIG. 3 shows a detailed structure of the light emitting element array in FIG. 2.

Optical writing device 22 is called as a printing head. As seen from FIGS. 2 and 3, each of optical writing devices 22 is placed close to the periphery of photo conductor drum 28 for the corresponding color. Each of optical writing devices 22 is placed at a downstream side in the rotational direction CW, being close to electrostatic charging unit 29 for the corresponding color. Each of optical writing devices 22 schematically includes board 222 which is fixed on holder 221, light emitting element array 223, GRIN lens array 224, and at least one of temperature sensor 225.

Light emitting element array 223 faces the periphery of photo conductor drums 28 for the corresponding color, interposing GRIN lens array 224. As seen from FIG. 3, light emitting element array 223 includes a prescribed number of light emitting elements 226 linearly arranged in the main scanning direction (in the Y-axis direction). Light emitting element 226 typically consists of an OLED (Organic Light Emitting Device).

The above mentioned prescribed number is from a few thousand to ten thousands, for example. Each of light emitting elements 226 is quadrilateral and about 50 square micro meter, for example. The prescribed number light emitting elements 226 are divided into a plurality of groups, for a temperature calculation in accordance with the embodiment. More specifically, light emitting element array 223 is virtually divided at intervals of distance measured in terms of $\Delta y=0.5$ mm along with the main scanning direction. A plurality of light emitting elements 226 in the range of $\Delta y$ in the main scanning direction belong to the same group.

GRIN lens array 224 is a micro lens array, a light-harvesting optical transmission body array, or the like. GRIN lens array 224 is placed in the optical axis directions of light emitting elements 226, facing light emitting elements 226. GRIN lens array 224 includes a plurality of refractive index distribution type lens (Graded Index Lens) arranged in the main scanning direction. GRIN lens array 224 concentrates light of incident optical beam B from light emitting elements 226 on the periphery of photo conductor drum 28 for corresponding color.

Imaging efficiency of the refractive index distribution type lens varies from light emitting element 226 to light emitting element 226, depending on the difference of the positional relationship between the optical axis of the light emitting element 226 and the center axes of the refractive index distribution type lens. An initial adjustment is performed when optical writing device 22 is fabricated, to prevent ununiformity of the exposure amount of photo conductor drum 28 to be exposed by optical writing device 22, due to the difference of imaging efficiency. The drive electrical current for each of light emitting elements 226 is adjusted, to make the exposure amount constant. The drive electrical current values for light emitting elements 226 are recorded in a table prepared in non volatile memory 321 (See the below table 1).

TABLE 1

| TABLE OF DRIVE ELECTRICAL CURRENT VALUES | | | | |
|---|---|---|---|---|
| LIGHT EMITTING ELEMENT | 1 | 2 | 3 | . . . |
| DRIVE ELECTRICAL CURRENT (μA) | 10.8 | 12.6 | 11.4 | |

Temperature sensor 225 is installed on the outside surface of holder 221. Temperature sensor 225 detects outside air temperature Tair of optical writing device 22, and sends the outside air temperature Tair to PH control unit 32.

According to the above structure, optical writing device 22 acquires ability to scan optical beam B for corresponding color, on the periphery of photo conductor drum 28 in the main scanning direction. Photo conductor drum 28 rotates in the direction of arrow CW. Hence, optical beam B is scanned in the sub scanning direction which is a direction opposite to the rotational direction CW. Therefore, electrostatic latent image for corresponding color is formed on the periphery of each of photo conductor drums 28.

Referring to FIG. 1 again, each of developing units 210 extends in the Y-axis direction. Each of developing units 210 faces the periphery of photo conductor drum 28 for corresponding color, at just downstream of the irradiate location of optical beam B. Each of developing units 210 provides toner on the periphery of photo conductor drum 28. Hereby, electrostatic latent image is developed on the periphery of photo conductor drums 28, and a toner image for corresponding color (one-colored) is formed.

As the result of the above developing process, each of photo conductor drums 28 holds a toner image for corresponding color on the periphery. As the result of rotation of photo conductor drums 28, toner images are conveyed to the downstream in the rotational direction CW.

Each of transfer units 23 extends in the Y-axis direction. Each of transfer units 23 faces the periphery of photo conductor drums 28 for corresponding color, at the downstream side of developing unit 210, interposing secondary transfer belt 24.

Secondary transfer belt 24 is an endless type belt. Secondary transfer belt 24 is put up with tension on drive roller 25 and driven roller 26, to place a part of secondary transfer belt 24 between transfer unit 23 and photo conductor drum 28 for corresponding color. Secondary transfer belt 24 can go round in the direction of arrow α. Secondary transfer belt 24 contacts photo conductor drums 28 with pressure by transfer units 23 to form primary transfer areas.

The bias electrical voltage is applied to transfer units 23. When a toner image conveyed by photo conductor drum 28 arrives at the primary transfer area, the toner image is electrostatically moved to the outer circumference surface of secondary transfer belt 24 (primary transfer). The toner images for colors are transferred to the same area on the surface of secondary transfer belt 24, to overlap the images. Such a synthesized toner image being held by secondary transfer belt 24 is conveyed toward secondary transfer roller 27, with secondary transfer belt 24 going round.

Secondary transfer roller 27 is placed facing drive roller 25 interposing secondary transfer belt 24. Secondary transfer roller 27 is pressed against secondary transfer belt 24, to form the secondary transfer area. The bias electrical voltage is applied to secondary transfer roller 27. In the secondary transfer area, the synthesized image conveyed by secondary transfer belt 24 is electrostatically transferred to recording medium S (secondary transfer).

Heat and pressure are applied to recording medium S on which the toner image was transferred, by a fixing unit. Hereby, the synthesized toner image is fixed on recording medium S. The recording medium S is discharged via a pair of discharge rollers to a discharge tray, as a sheet of printed paper.

Image forming apparatus 1 is equipped with control unit 3 to control the above units. Control unit 3 consists of a CPU, a main memory, or the like, and works in accordance with prepared programs. Control unit 3 controls printing behavior of image forming apparatus 1. Control unit 3 also controls driving of optical writing device 22, which will be explained in the followings.

Chapter 3: Detailed Structures of the Control Unit and the Board

Figure 4:
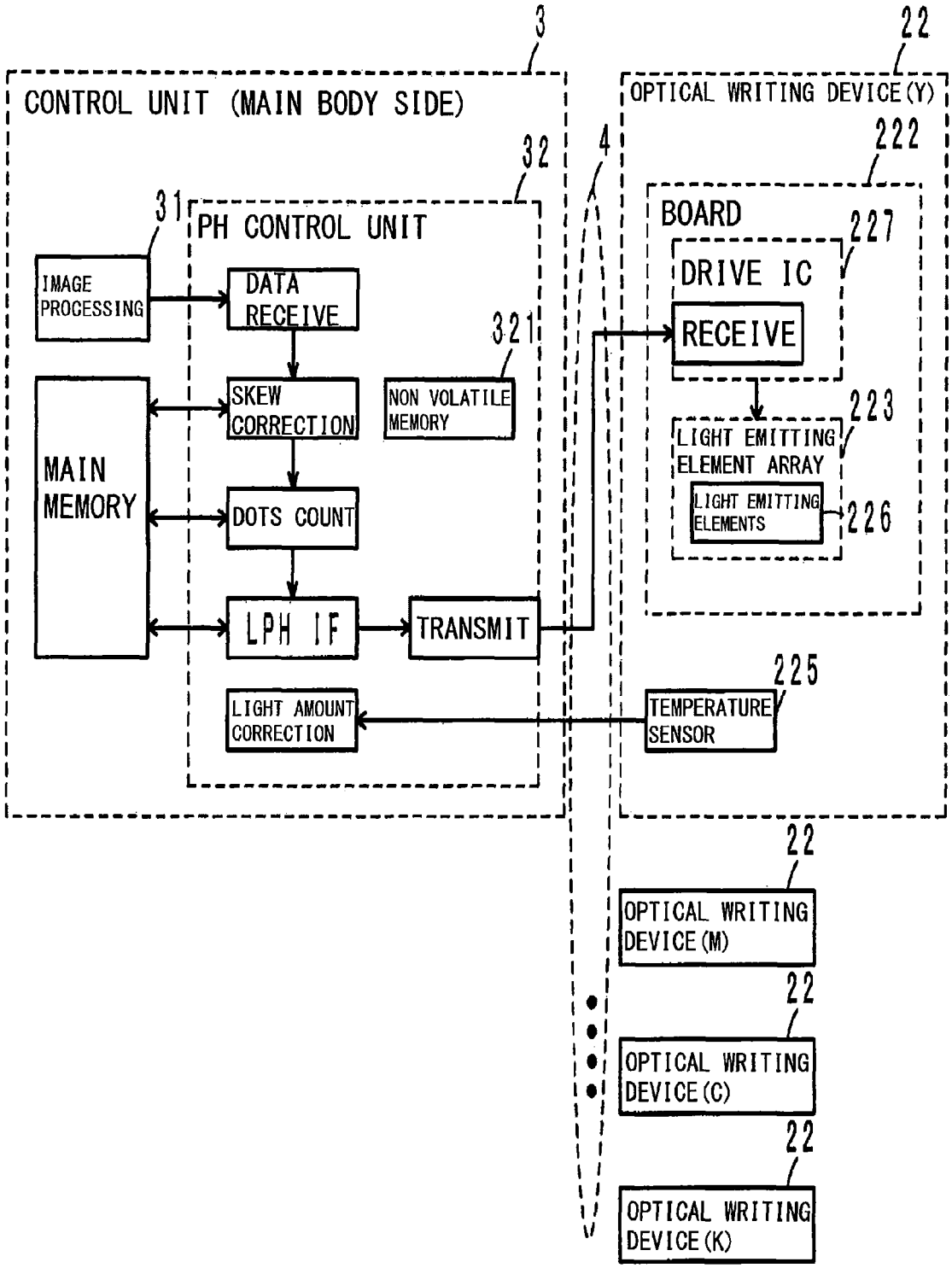
FIG. 4 shows a block diagram of a main section of the image forming apparatus.

As shown by FIG. 4, control unit 3 at least includes image processing unit 31, and PH control unit 32 to control driving of optical writing devices 22 for colors of YMCK.

Images processing unit 31 receives printing instructions made by predetermined page-description language. Images processing unit 31 analyzes the page-description language for each of recording media S to be printed (namely, for each of printing pages). For example, image processing unit 31 generates rasterized data which represents 1200 dpi binary images, for colors.

PH control unit 32 corrects tilt (as it is called skew correction) of optical writing devices 22 in rasterized data received from image processing unit 31 for colors, on the memory. PH control unit 32 counts the number of dots, to administrate light emitting time of each of light emitting elements 226. After that, PH control unit 32 transmits rasterized data for each of colors to drive IC 227 which is equipped on board 222 for corresponding color, via FFC (Flexible Flat Cable) 4. Data transmission from PH control unit 32 to board 222 is preferably performed via a clock synchronization data bus of around 80 MHz high-speed transmissions, for example LVDS (Low Voltage Differential Signaling). In addition to the rasterized data for colors, control signals such as clock signals and line synchronization signals are transmitted from PH control unit 32 to boards 222.

In addition to the light emitting element array 223, each of boards 222 is at least equipped with drive IC 227. Drive IC 227 drives light emitting elements 226 for corresponding color. At this time, drive IC 227 performs temperature correction of drive electrical current value of each of light emitting elements 226, by using the following methods, and provides the corrected value to each of light emitting elements 226. Hereby, each of light emitting elements 226 emits light to expose photo conductor drum 28 for corresponding color.

Chapter 5: Initial Temperature Setting of the Image Forming Apparatus

Next, referring to FIG. 5, an initial temperature setting of the image forming apparatus 1 will be explained. The initial temperature setting is performed when receiving a printing instruction from a personal computer or the like which is not shown in the Figures.

Firstly, PH control unit 32 acquires the present outside air temperature Tair from temperature sensor 225 (S001). When the present outside air temperature Tair is less than reference temperature Tref (for example, a temperature between 20 degree Celsius to 30 degree Celsius) which was beforehand preset (S002), the image forming apparatus considers that temperatures of all the light emitting elements 226 become substantively equalized by heat radiation. In this case, the image forming apparatus sets outside air temperature Tair acquired in S001 as initial temperatures of all the groups A (S003), and terminates the process of FIG. 5.

On the other hand, when the present outside air temperature Tair is not less than reference temperature Tref at S002, PH control unit 32 executes the following S004 and S005.

PH control unit 32 stores clock time when the previous printing process was over (hereinafter, simply referred to as the previous finish time), and temperatures for groups at the clock time (hereinafter, simply referred to as previous temperatures) in non volatile memory 321. At S004, PH control unit 32 reads the finish time of the previous printing process, and temperatures for groups (the previous temperatures) at the finish time of the previous printing process.

PH control unit 32 periodically acquires outside air temperature Tair from temperature sensor 225, for each time step Δt (for example, every 0.25 seconds) which will be explained in the followings, from the finish time of the previous printing process. PH control unit 32 stores the acquired outside air temperature Tair in non volatile memory 321. Namely, PH control unit 32 periodically monitors outside air temperature Tair, after the finish time of the previous printing process. At S005, PH control unit 32 acquires outside air temperature Tair at each of time steps Δt.

After that, PH control unit 32 calculates the present temperatures for the groups, by using the following recursion formula (1).

[FORMULA 1]

$$T(t0+\Delta t, 0) = T(t0, 0) + \frac{Q(t0, 0)}{\rho \cdot C \cdot V} - \frac{\beta \cdot S \cdot \Delta t}{\rho \cdot C \cdot V}(T(t0, 0) - T_{air}) + \frac{\alpha \cdot \Delta t}{(\Delta y)^2}(T(t0, -1) + T(t0, +1) - 2 \cdot T(t0, 0)) \quad (1)$$

Here, "A0" represents a group where the temperature is to be calculated. "A+1" represents a group adjacent to the group "A0" in the main scanning direction. "A−1" represents a group adjacent to the group "A0" in a direction opposite to the main scanning direction. Q(t0, 0) represents the amount of heat generation of group A0 from clock time t0 to t0+Δt. T(t, −1), T(t, 0), and T(t, +1) represent temperatures of groups A−1, A0, and A+1 at clock time t, respectively.

According to the above formula (1), temperature T(t0+Δt, 0) of group A0 at clock time t0+Δt is calculated, based on temperature T(t0, 0) of group A0 at clock time t0, the amount of heat generation Q(t0, 0) of group A0 from clock time t0 to t0+Δt, and temperatures T(t0, −1), T(t0, +1) of the adjacent area at the clock time t0.

"ρ", "C", and "k" represent density, specific heat, and heat conductivity of board 222 respectively. They are known values. Further, α=k/ρC is a known value. "β" represents heat conductivity between the board and ambient air, which is a known value. "S" represents the surface area of board 222, being occupied by light emitting elements 226 which belong to group A0. "S" is a known value. "V" represents the volume being occupied by light emitting elements 226 which belong to group A0. "V" is a known value. "Tair" represents an outside air temperature acquired by temperature sensor 225 at clock time t0.

When PH control unit 32 calculates temperature T(t0+Δt, 0) of the first time step Δt after the previous printing process finish time, PH control unit 32 plugs in the temperatures at the previous printing process finish time (the previous temperatures) which were read in S004 of the corresponding groups for T(t0, 0), T(t0, −1), and T(t0, +1) in the above formula (1). Also, PH control unit 32 plugs in outside air temperature Tair stored in non volatile memory 321, which is the outside air temperature Tair at the previous printing process finish time, for outside air temperature Tair in the above formula (1). Because light emitting elements 226 have not been turned on from the previous printing process finish time to the time when receiving the printing instruction, Q(t0,0) is "0".

The above calculation is performed for all the groups, to calculate temperature T(t0+Δt, 0) of the first time step Δt. When calculating temperature T(t0+Δt, 0) of the next time step Δt, PH control unit 32 plugs in the temperatures calculated at the previous time step Δt of the corresponding groups, for T(t0, 0), T(t0, −1), and T(t0, +1) in the above formula (1). Also, PH control unit 32 plugs in outside air temperature Tair stored in non volatile memory 321, which is outside air temperature Tair at the previous time step Δt (or outside air temperature Tair during the passage of time from the finish time of the previous time step Δt to when time step Δt elapses, or outside air temperature Tair when the period of time step Δt has elapsed from the finish time of the previous time step Δt) for the outside air temperature Tair in the above formula (1). The calculation is performed for all the groups.

The above calculation (the process in which temperature T(t0+Δt, 0) at the next time step is calculated by plugging in temperature T(t0, 0), T(t0, −1), and T(t0, +1) calculated at the previous time step and outside air temperature Tair at the previous time step for formula (1)) is repeated. By the calculation, PH control unit 32 derives temperatures at the present time for the groups (S006). After that, PH control unit 32 sets the temperatures for the groups as initial temperatures (S007), and terminates the process of FIG. 5.

Figure 5:
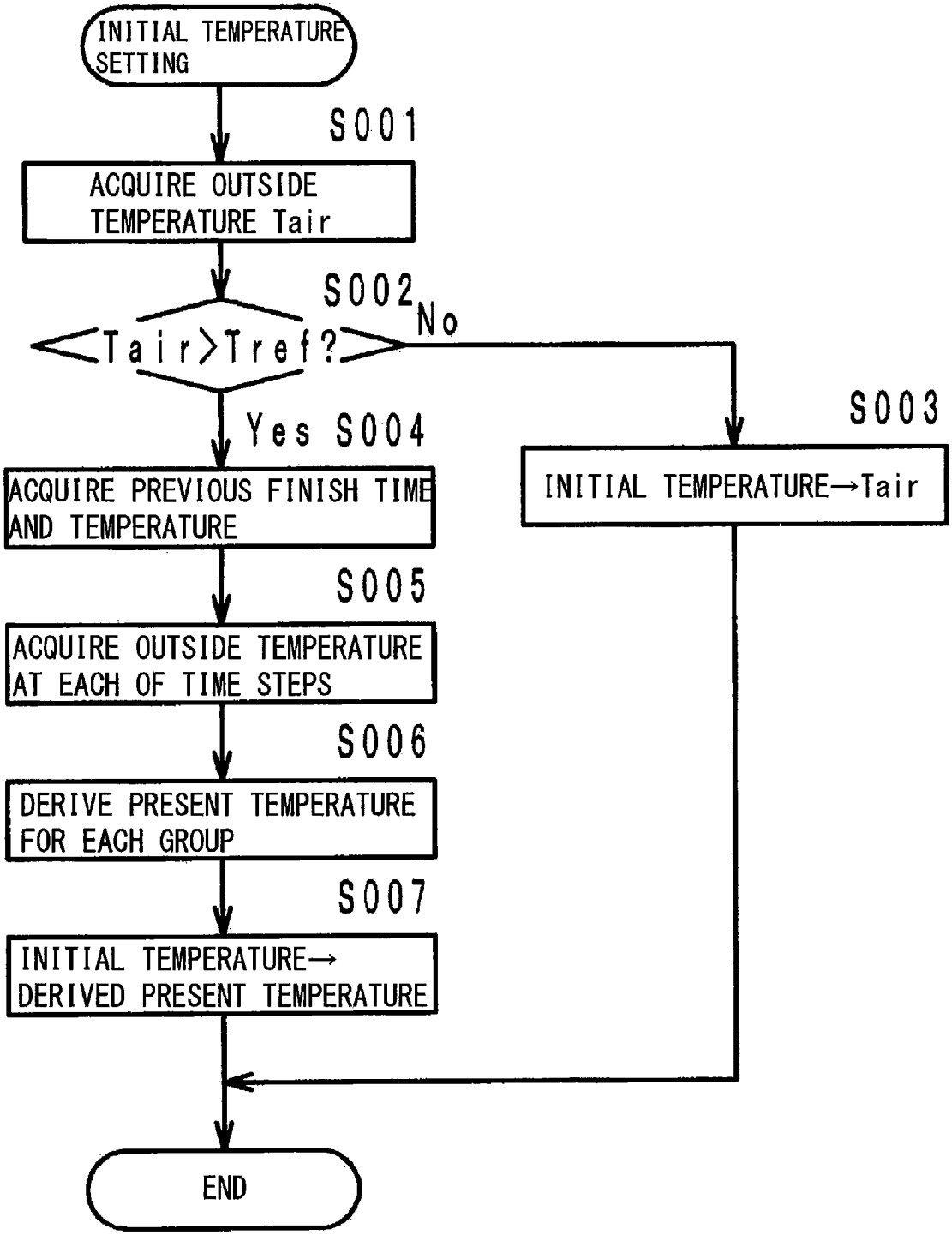
FIG. 5 shows a flowchart of a configuration procedure for initial temperatures performed by the PH control unit in FIG. 4.

In the exemplification of FIG. 5, PH control unit 32 monitors the outside air temperature. As substitute for the exemplification, PH control unit 32 may acquire outside air temperature Tair of each of time steps Δt by the result of interpolating between the previous temperature and the present outside air temperature for each of groups. As a specific interpolation method, the linear interpolation may be adopted. The interpolation may be performed by using a function made from the result of actual measurement which was beforehand done. The other interpolation methods can be adopted.

The above mentioned Δt and Δy can be appropriately changed, based on heat conductivity of board 222, self-generated heat amount of each of light emitting elements 226, the required calculation precision, or the like. The values which well mach the computer simulation or the result of actual measurement of temperature distribution of the light emitting element array 223 are preferably selected as Δy and Δt to be used.

Chapter 6: Calculation of Element Temperatures of the Image Forming Apparatus The calculation method for an amount of change of element temperatures of a group A0 from a clock time t0 to clock time t0+Δt will be explained. The element temperatures can be calculated in units of time step Δt for each group, by applying the calculation method to the groups repeatedly.

Figure 6:
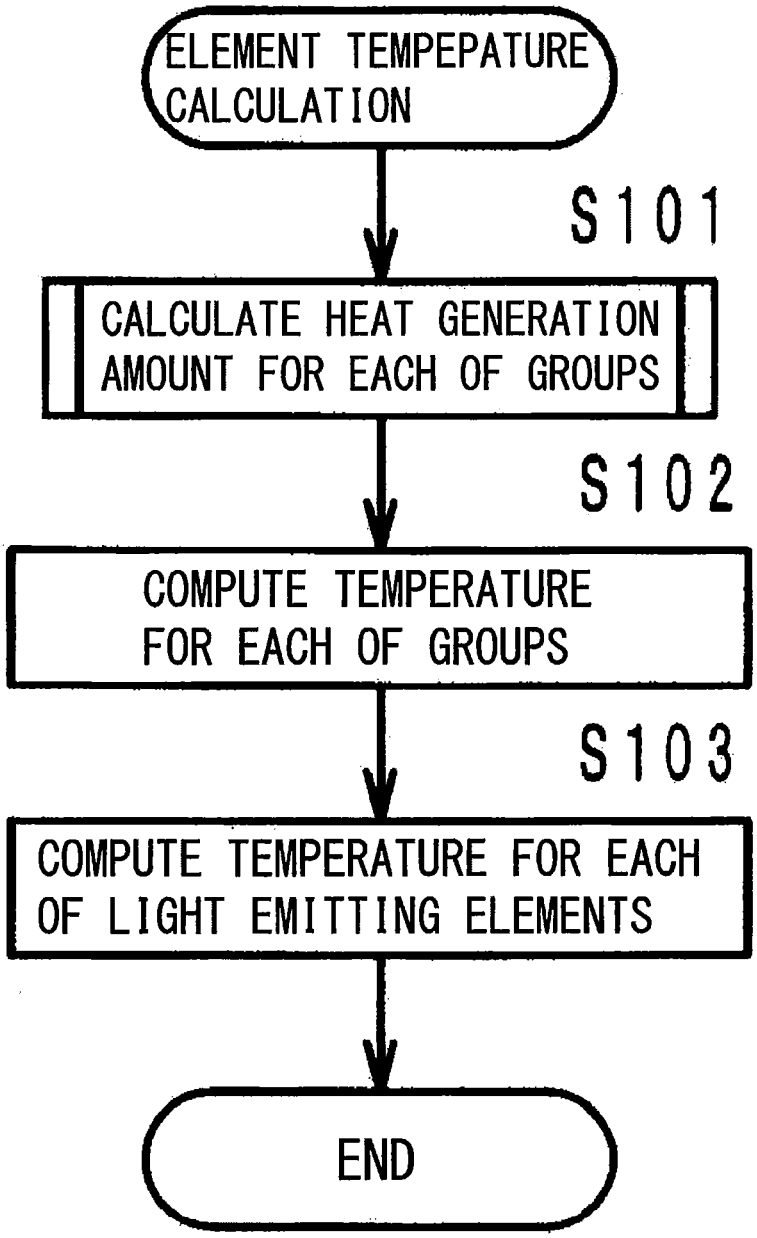
FIG. 6 shows a main flowchart of a calculation procedure for element temperatures performed by the PH control unit in FIG. 4.

As seen in FIG. 6, the calculation method for element temperatures of the embodiment includes a calculation step of the amount of heat generation for each group, computation step of temperature of each group, and computation step of temperature of each light emitting element 226 by interpolation (S101 to S103).

The process of FIG. 6 may be collectively performed for all the pages to be printed, when image forming apparatus 1 receives a printing instruction. The process of FIG. 6 may be performed each time one page is printed, for the next page.

Next, the process of S101 in FIG. 6 (the calculation step of the amount of heat generation for each group) will be explained in detail, referring to FIG. 7. In the following description, the calculation object of the amount of heat generation should be group A0.

Figure 7:
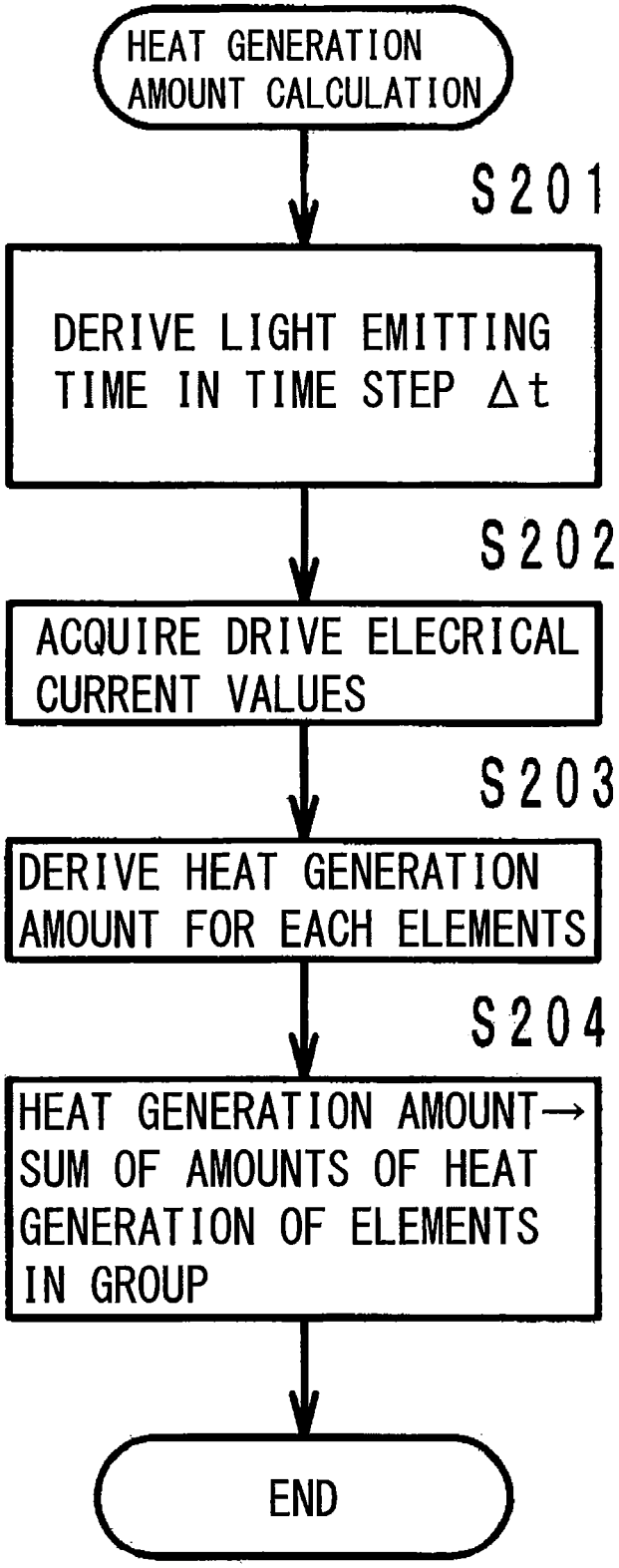
FIG. 7 shows a flowchart of a detailed procedure of S101 (a step for calculating the amount of heat generation for each group) in FIG. 6.

In FIG. 7, PH control unit 32 derives light emitting time in time step Δt for each light emitting element 226 which belongs to group A0, based on data to be written on photo conductor drums 28 from clock time t0 to t0+Δt, among rasterized data generated by image processing unit 31 (S201).

Next, PH control unit 32 reads the drive electrical current values of light emitting elements 226 which are calculation objects, from non volatile memory 321 (S202).

Next, PH control unit 32 derives the amounts of heat generation for light emitting elements 226 which are calculation objects, by the expression of (light emitting time)*(drive electrical current value)*(drive electrical voltage value)*(heat generation efficiency) (S203). Here, a value which was beforehand prescribed to drive light emitting element 226 is used as the drive electrical voltage value. A value measured beforehand by the experiment is used as the heat generation efficiency.

Next, PH control unit 32 calculates the sum of all the amounts of heat generation derived in S203, as the amount of heat generation Q(t0,0) of group A0 from clock time t0 to clock time t0+Δt (S204). PH control unit 32 derives the amount of heat generation Q(t0,0) for each group, for all the time steps Δt, as for rasterized data. After that, PH control unit 32 terminates the process of FIG. 7.

In case that the heat generation efficiency varies among light emitting elements 226 which are calculation objects, more than or equal to ±5% for example, heat generation efficiency is preferably measured for each light emitting element 226, at the time of manufacturing of board 222. In S203, the heat generation efficiency for each light emitting element 226 can be used.

Next, the process of S102 as shown in FIG. 6 (the computation step of temperature for each group) will be explained in detail. PH control unit 32 uses the recursion formula of the above formula (1), for calculating temperature for each group.

[FORMULA 2]

$$T(t0+\Delta t, 0) = T(t0, 0) + \frac{Q(t0, 0)}{\rho \cdot C \cdot V} - \frac{\beta \cdot S \cdot \Delta t}{\rho \cdot C \cdot V}(T(t0, 0) - T_{air}) + \frac{\alpha \cdot \Delta t}{(\Delta y)^2}(T(t0, -1) + T(t0, +1) - 2 \cdot T(t0, 0)) \quad (1)$$

When PH control unit 32 calculates temperature T(t0+Δt, 0) of the first time step Δt since this printing start time, PH control unit 32 plugs in the initial temperatures being set by the above mentioned initial temperature settings of the corresponding groups, for T(t0, 0), T(t0, −1), and T(t0, +1) in the above formula (1). Also, PH control unit 32 plugs in outside air temperature Tair acquired by temperature sensor 225 for outside air temperature Tair in the above formula (1). Because light emitting elements 226 are turned on from start of printing, the value acquired in S203 which is not zero is plugged in for Q(t0,0). This is differently from the initial temperature setting.

The above calculation is performed for all the groups, to calculate temperature T(t0+Δt, 0) of the first time step Δt. When calculating temperature T(t0+Δt, 0) of the next time step Δt, PH control unit 32 plugs in the temperatures calculated at the previous time step Δt of the corresponding groups for T(t0, 0), T(t0, −1), T(t0, +1) in the above formula (1). Also, PH control unit 32 plugs in the value of the corresponding group calculated by the process of FIG. 7 for Q(t0,0) in the above formula (1).

By repeating the above calculation, PH control unit 32 calculates the temperatures for all the groups at all the time steps Δt. In this calculation, ambient air atmospheric temperature Tair of each time step Δt is needed. It may be estimated by an interpolation from outside air temperature Tair of temperature sensor 225, which was acquired at the first time step Δt. PH control unit 32 writes the time step Δt and temperature for each of groups, and the present outside air temperature Tair, in non volatile memory 321, for the next initial temperature setting.

Figure 8A:
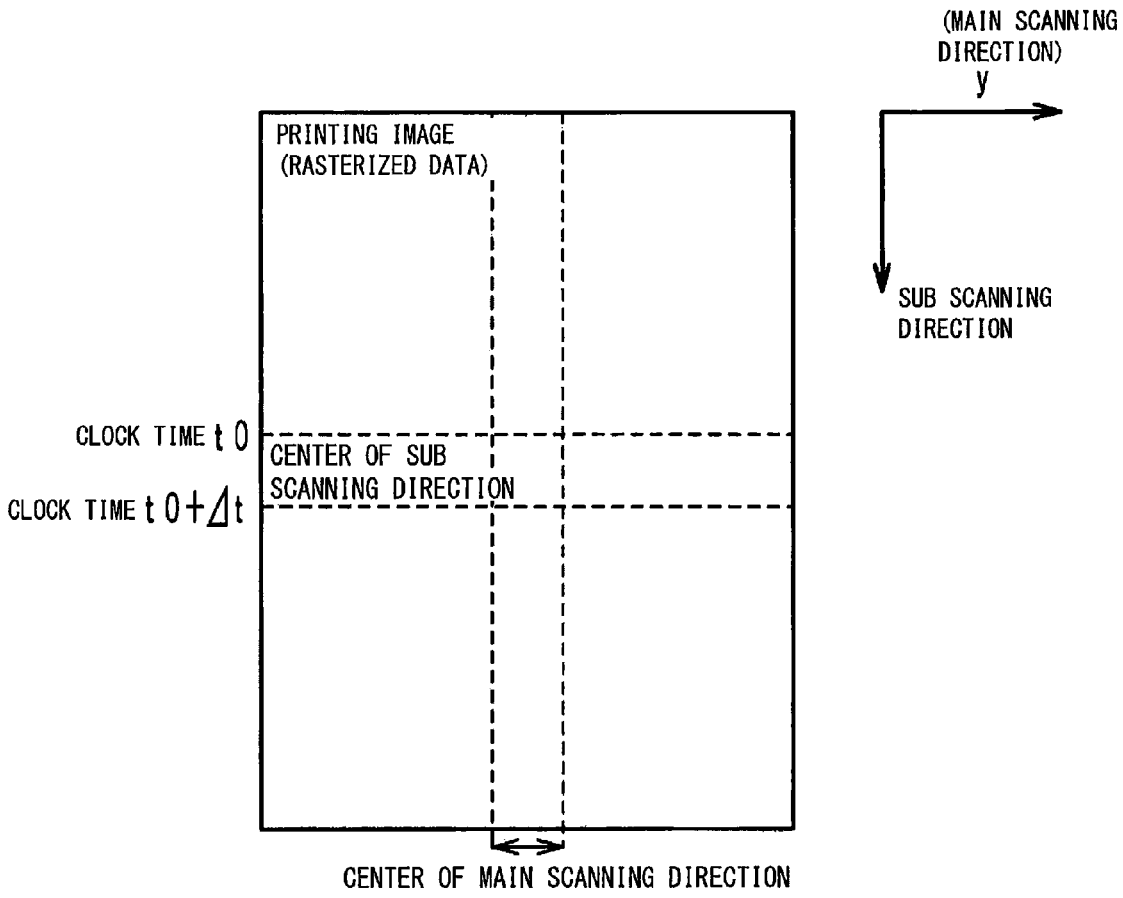
FIG. 8A shows the central part of a printing image.
Figure 8B:
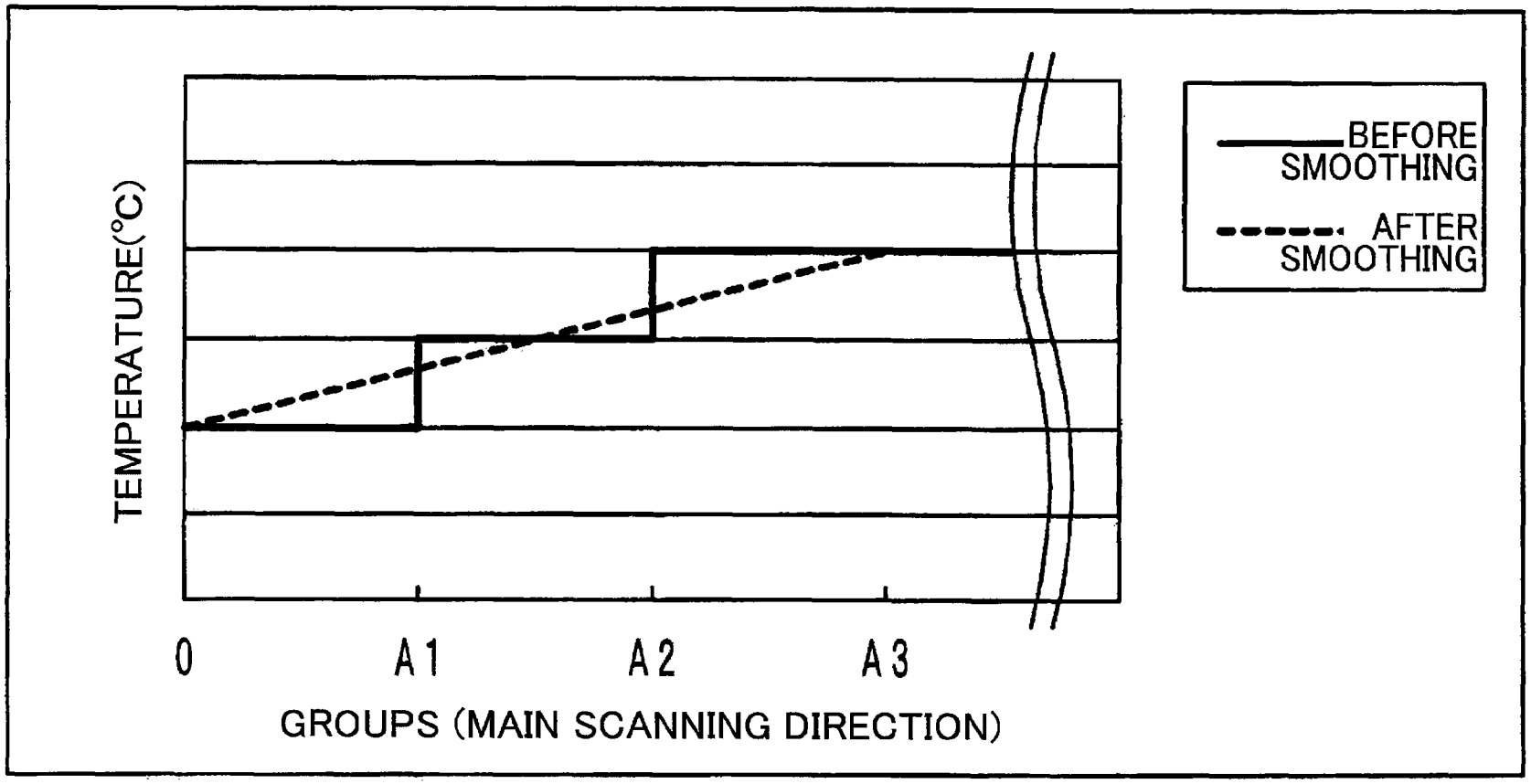
FIG. 8B shows temperature distribution in the main scanning direction, in units of groups, acquired in S103 of FIG. 6.

Next, the process of S103 shown in FIG. 6 (the computation step of the temperature of each light emitting element 226) will be explained in detail. PH control unit 32 calculates the temperature of each light emitting element at clock time when the center of each page is printed, as shown by FIG. 8A for example, based on temperature acquired for each of the groups at each time step Δt. More specifically, since the temperatures are calculated in units of groups at S102, the distribution of the temperatures at the center line in the sub scanning direction is steps-like waveform as shown in FIG. 8B (see the solid line). PH control unit 32 smoothens the steps-like distribution of the temperatures for the groups, to remove the high frequency component. After that, PH control unit 32 makes the temperature which corresponds to the location of each light emitting element 226 in the main scanning direction on the temperature distribution acquired by the smoothing (see the broken line in FIG. 8), as the temperature of the light emitting element 226 (S103). The drive electrical current of light emitting elements is controlled in units of elements, not in units of groups.

According to the embodiment, the temperature at printing time of the center line of each of pages is calculated. In this instance, the drive electrical current of light emitting element 226 is unchanged during printing one page. However, since the time needed to print one page is merely about 0.5 second to about 1 second, the fluctuation of the amount of light of light emitting element 226 due to temperature increase during such a short period is merely equal to or less than about 0.1%. Therefore, even though the drive electrical current of light emitting element 226 is unchanged during printing one page, it has no impact on image quality substantially.

Chapter 7: Temperature Correction for Drive Electrical Current, According to the Image Forming Apparatus Next, temperature correction for drive electrical current being supplied to each of light emitting elements 226 will be explained, referring to FIG. 9. PH control unit 32 holds a table which describes the ratio of the amount of light emitting at each element temperature, for each light emitting element 226, provided the amount of light emitting L1 at beforehand prescribed reference temperature T1 is 100%, in non volatile memory 321. The temperature characteristics of the amount of light emitting of a light emitting element 226 is shown the below table 2.

TABLE 2

| TEMPERATURE CHARACTERISTICS TABLE OF LIGHT EMITTING AMOUNT | | | | |
|---|---|---|---|---|
| ELEMENT TEMPERATURE (° C.) | T1 | T2 | T3 | . . . |
| LIGHT EMITTING AMOUNT RATIO (%) | 100 | 98 | 96 | . . . |

Figure 9:
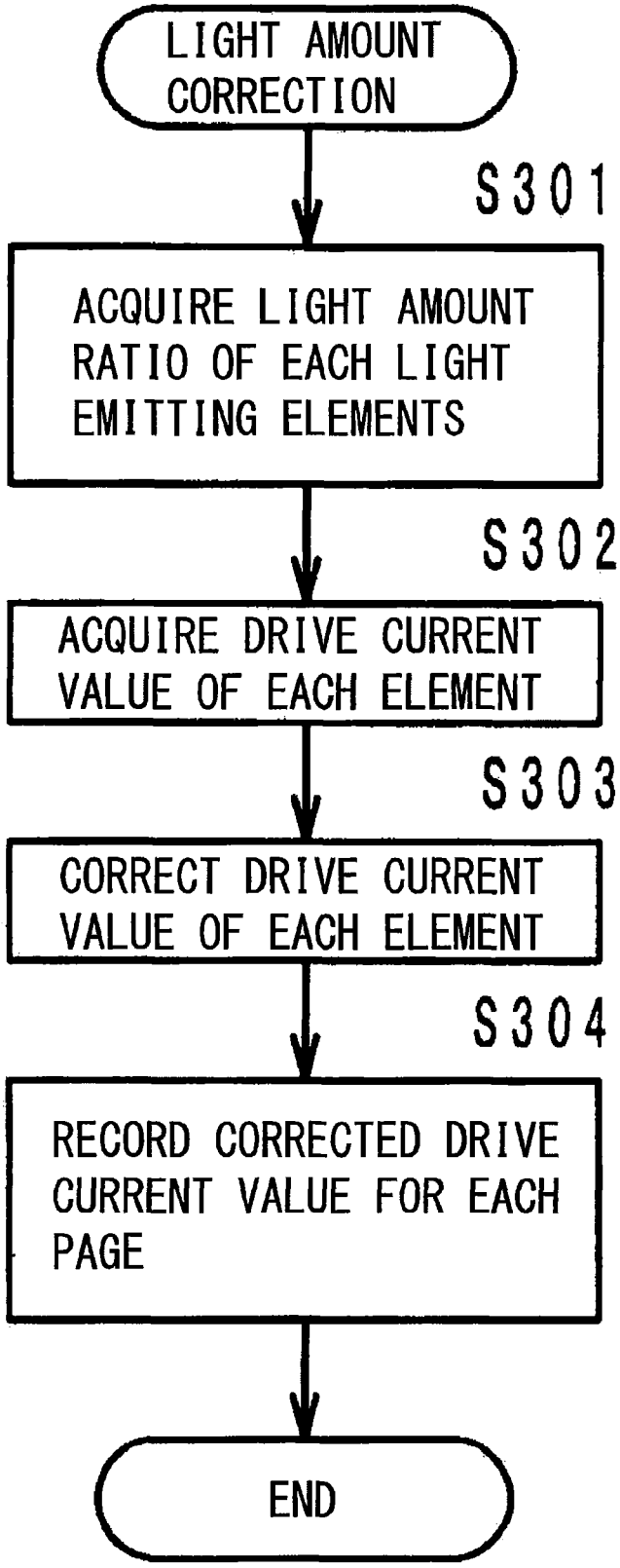
FIG. 9 shows a flowchart of a procedure of drive electrical current correction, in accordance with the light amount, performed by the PH control unit.
Figure 10:
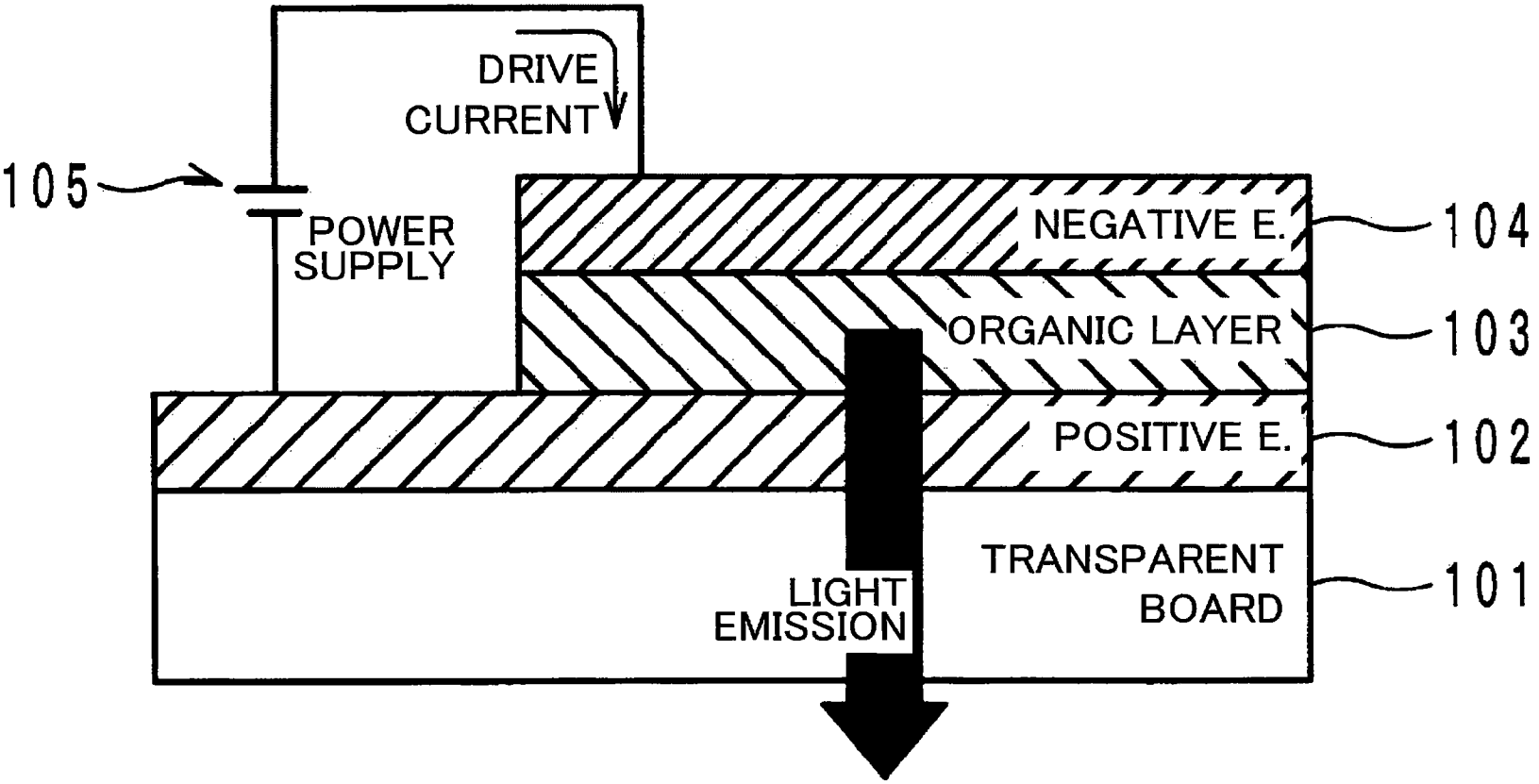
FIG. 10 shows a structure of a generic organic EL element.
Figure 11:
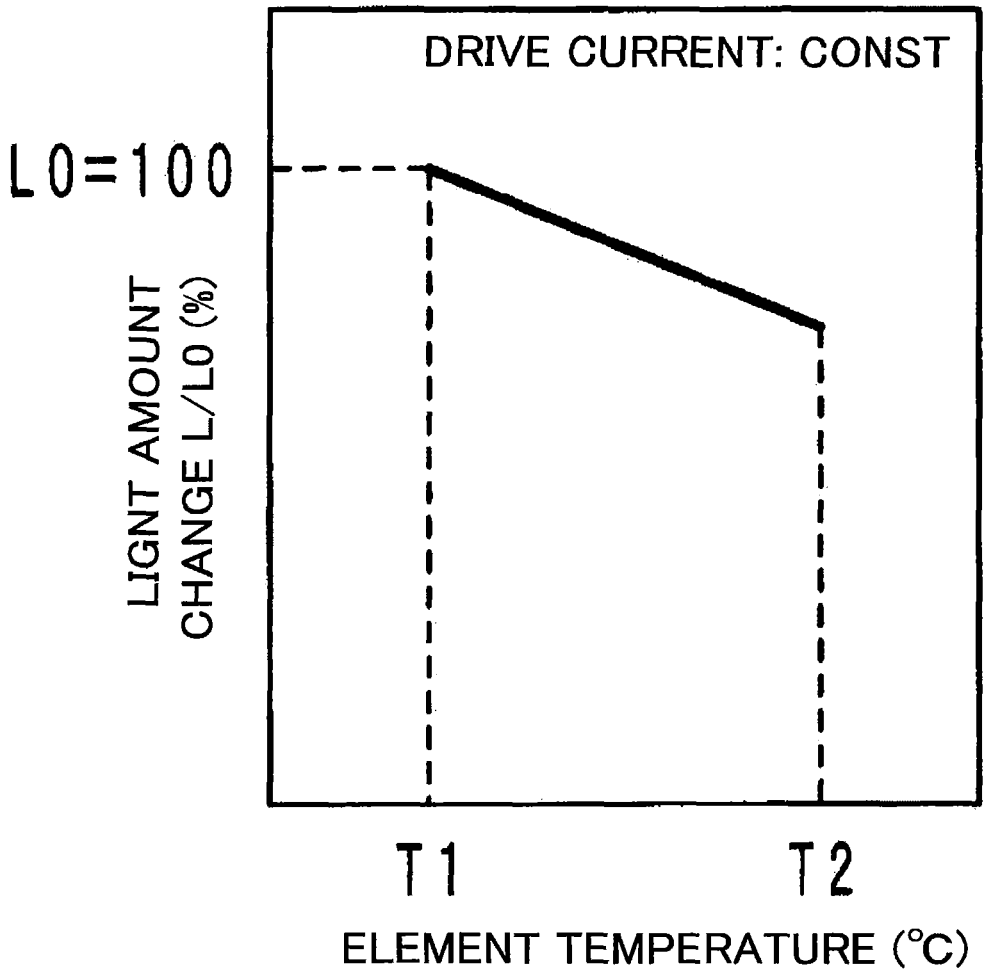
FIG. 11 shows the temperature characteristics of the amount of light emitted by an organic EL element.
Figure 12:
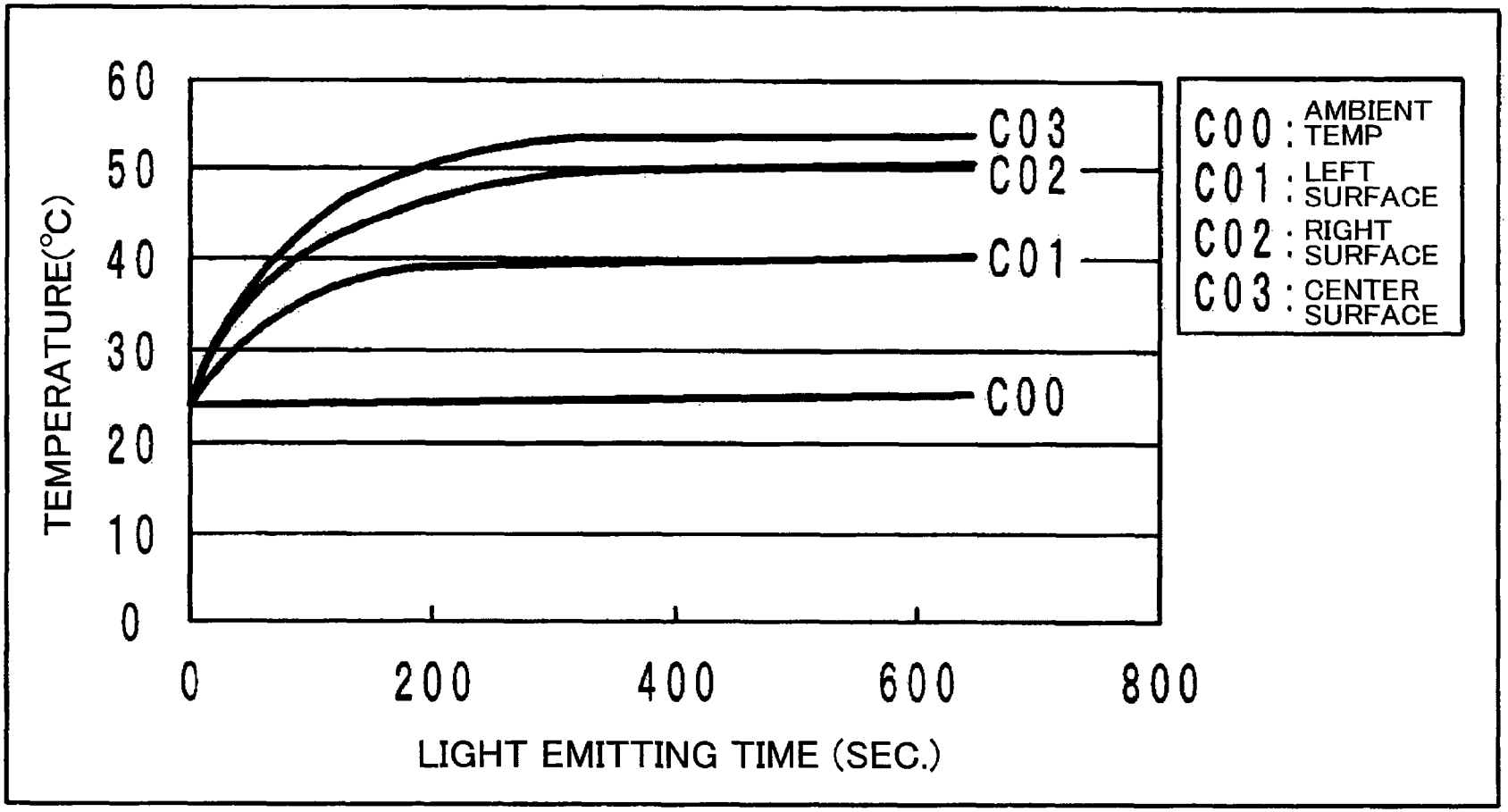
FIG. 12 shows the change of element temperature of an organic EL element, with the passage of time.
Figure 13:
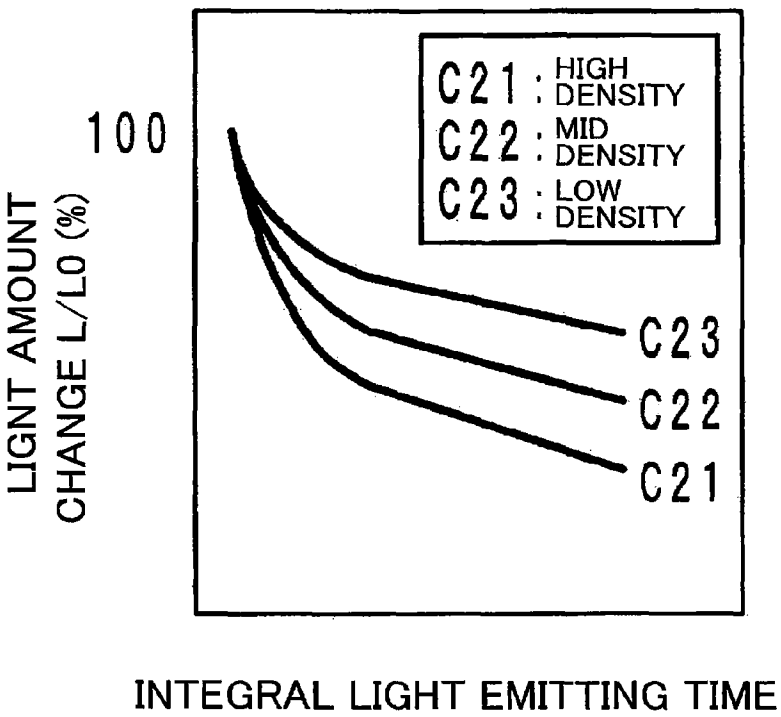
FIG. 13 shows the temperature dependency and the electrical current density dependency of the light amount change of an organic EL element, with the passage of time.
Figure 13:
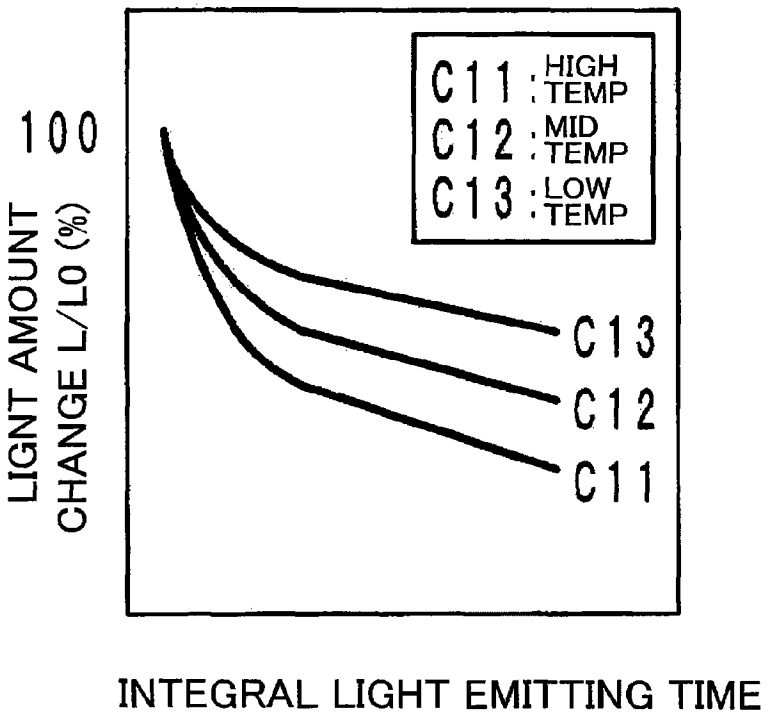

PH control unit 32 acquires the ratio of the amount of light emitting which corresponds to the element temperature of each light emitting element 226, acquired at S103, for each of pages to be printed (FIG. 9; S301). PH control unit 32 acquires the drive electrical current value for each light emitting element 226 from non volatile memory 321 (S302). Next, PH control unit 32 divides the drive electrical current value by the ratio of the amount of light emitting, for each light emitting element 226, to derive the corrected drive electrical current value (S303). After that, PH control unit 32 records the corrected drive electrical current value to correspond with the page number to be printed, in non volatile memory 321 (S304).

After that, when the objective page is being printed, PH control unit 32 reads the corrected drive electrical current value stored in non volatile memory 321. PH control unit 32 provides the drive electrical current value which was read to the objective light emitting element 226.

Chapter 8: Function and Effect of the Image Forming Apparatus

As described above, according to the image forming apparatus 1, at least one of temperature sensor 225 is needed. However, according to the image forming apparatus 1, there is no need to use various measuring means for each light emitting element 226, to derive the temperature of each light emitting element 226. Therefore, optical writing devices and image forming apparatuses being able to obtain temperatures of light emitting elements can be provided, adopting a low cost and simple structure.

Further, as secondary effects, it is possible to correct the fluctuation of the amount of light by deterioration of the amount of light emitting caused by temperature or electrical current density, with more precision, by reference to calculated element temperature of light emitting element 226.

Further, when the temperature of light emitting element 226 increases locally, a driving stop control to prevent light emitting element 226 from breaking can be performed.

Further, the temperature change caused when light emitting element 226 is lit before the printing start or at an interval between a previous paper sheet and a following paper sheet can be followed, for the purpose of a warm-up operation or the purpose of equalizing the degree of deterioration of light emitting elements 226.

Chapter 9: Additional Explanations

The above embodiment was explained, in that it is especially suitable for OLEDs. However, the embodiment is not limited to OLEDs. The embodiment is applicable to light emitting element 226 of which the amount of light emitting changes by the self-generated heat. For example, the embodiment is applicable to laser diodes.

After the temperature of light emitting element 226 is saturated due to long time printing, PH control unit 32 may continuously use the constant temperature, instead of calculating the temperature until the printing is over. Hereby, the memory size for holding the calculation results can be saved. To perform this process, a threshold value of the element temperature obtained by the calculation is set. When an element temperature obtained by the calculation exceeds the threshold value, the following calculations are omitted.

The formula (1) may be appropriately modificated, based on process capacity of optical writing device 22 or image forming apparatus 1, the memory size, and calculation precision needed for correction. For example, the following formula (2) can be adopted, when the amount of heat generation of groups A+1, and A−1 adjacent to the target group A0 should be considered by using light emitting elements of which the self-generated heat is large, by using Δt which is large, or the like.

[FORMULA 3]

$$\begin{aligned} T(t0+\Delta t, 0) = {} & T(t0, 0) + \frac{Q(t0, 0)}{\rho \cdot C \cdot V} - \frac{\beta \cdot S \cdot \Delta t}{\rho \cdot C \cdot V}\left(T(t0, 0) + \frac{Q(t0, 0)}{2\rho \cdot C \cdot V} - T_{air}\right) + \\ & \frac{\alpha \cdot \Delta t}{(\Delta y)^2}\left\{\left(T(t0, -1) + \frac{Q(t0, -1)}{2\rho \cdot C \cdot V}\right) + \left(T(t0, +1) + \frac{Q(t0, +1)}{2\rho \cdot C \cdot V}\right) - 2 \cdot \left(T(t0, 0) + \frac{Q(t0, 0)}{2\rho \cdot C \cdot V}\right)\right\} \end{aligned} \quad (2)$$

According to the formula (2), the temperature increase by self-generated heat is corrected. When the correction, the temperature at clock time t0 to which a half of an amount of temperature increase by self-generated heat from clock time t0 to clock time t0+Δt was added is employed as the temperature used for calculating heat release to ambient air and heat transmission from the adjacent groups A+1, and A−1. Namely, the temperature at clock time t0 itself is not employed as the temperature used for calculating heat release to ambient air and heat transmission from the adjacent groups A+1, and A−1.

The following formula (3) may be employed as substitute for formula (1), in case that heat transmission from adjacent groups A+1, and A−1 can be ignored by using material of low heat conductivity as board 222, or when each light emitting element 226 is surrounded by material of low heat conductivity.

[FORMULA 4]

$$T(t0+\Delta t, 0) = T(t0, 0) + \frac{Q(t0, 0)}{\rho \cdot C \cdot V} - \frac{\beta \cdot S \cdot \Delta t}{\rho \cdot C \cdot V}(T(t0, 0) - T_{air}) \quad (3)$$

According to the embodiment, table 1 is used for calculating corrected drive electrical current. However, the invention is not limited to the table. Formulas for calculating the amount of light emitting by plugging in element temperature as for each light emitting element 226 can be employed.

According to the above aspects, optical writing devices and image forming apparatuses being able to obtain temperatures of light emitting elements can be provided, adopting a low cost and simple structure.

INDUSTRIAL APPLICABILITY OF THE INVENTION

An optical writing device and an image forming apparatus according to this invention is suitable for a facsimile apparatus, a copying apparatus, a printer, or a multifunction machine having these functions, regardless of color device and black-and-white device.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An optical writing device comprising:

a plurality of light emitting elements being arranged linearly in a main scanning direction, wherein an amount of light emitting of the plurality of light emitting elements changes by self-generated heat, and the plurality of light emitting elements are divided into a plurality of groups, each of the groups includes a prescribed number of light emitting elements which are arranged in the main scanning direction, the optical writing device further comprising: a control unit for calculating an amount of heat generation of the plurality of light emitting elements for each of the groups from clock time t0 to clock time t0+Δt, wherein the control unit further calculates a temperature for each of the groups at the clock time t0+Δt, based on the amount of heat generation from the clock time t0 to the clock time t0+Δt and a temperature at the clock time t0.

2. The optical writing device according to claim 1, wherein the control unit calculates the amount of heat generation of the plurality of light emitting elements for each of groups from clock time t0 to clock time t0+Δt, based on drive electrical current and applied electrical voltage being supplied to the light emitting elements included in each of the groups, heat generation efficiency of the light emitting elements, and light emitting time of the light emitting elements from the clock time t0 to the clock time t0+Δt.

3. The optical writing device according to claim 1, wherein the control unit uses an amount of heat generation of the objective group from the clock time t0 to the clock time t0+Δt, and a temperature of a group adjacent to the objective group at the clock time t0, for calculating the temperature of each of the groups.

4. The optical writing device according to claim 3, wherein the control unit further uses an amount of heat generation of the group adjacent to the objective group from the clock time t0 to the clock time t0+Δt.

5. The optical writing device according to claim 3, further comprising:

a temperature sensor for measuring an outside air temperature around each of the light emitting elements, wherein the control unit uses the outside air temperature measured by the temperature sensor, from the clock time t0 to the clock time t0+Δt, for calculating the temperature of each of the groups.

6. The optical writing device according to claim 1, wherein the control unit calculates the temperature of each of the light emitting elements, after smoothing temperature distribution calculated for each of the groups.

7. The optical writing device according to claim 1, wherein the control unit performs temperature correction on the drive electrical current value of each of the light emitting elements, based on the temperature calculated for each of the groups.

8. The optical writing device according to claim 1, wherein each of the light emitting elements is an organic EL element.

9. An image forming apparatus comprising the optical writing device according to claim 1.

* * * * *